US005472292A

United States Patent [19]

Wiley

[11] Patent Number: 5,472,292

[45] Date of Patent: Dec. 5, 1995

[54] PROCESS FOR RECYCLING AN ASPHALT SURFACE AND APPARATUS THEREFOR

[75] Inventor: Patrick C. Wiley, Vancouver, Canada

[73] Assignee: McLean Ventures Corporation, Vancouver, Canada

[21] Appl. No.: 290,962

[22] PCT Filed: Feb. 19, 1993

[86] PCT No.: PCT/CA93/00069

§ 371 Date: Aug. 22, 1994

§ 102(e) Date: Aug. 22, 1994

[87] PCT Pub. No.: WO93/17185

PCT Pub. Date: Sep. 2, 1993

[30] Foreign Application Priority Data

Feb. 21, 1992 [CA] Canada ..... 2061682

[51] Int. Cl.[6] ..... E01C 7/06

[52] U.S. Cl. ..... 404/79; 404/90; 404/95

[58] Field of Search ..... 404/79, 77, 90–95

[56] References Cited

U.S. PATENT DOCUMENTS 4,545,700 10/1985 Yates ..... 404/79 X 4,793,730 12/1988 Butch ..... 404/79 X

*Primary Examiner*—Michael Powell Buiz

*Attorney, Agent, or Firm*—Darby & Darby

[57] ABSTRACT

A process for recycling an asphaltic surface. The process comprises: (a) providing an asphaltic surface having an upper surface for recycling; (b) rupturing the upper surface to a depth of at least about 1.5 inches to provide a ruptured upper surface; (c) heating and mixing the ruptured upper surface on the asphalt surface to a temperature in the range of from about 100° to about 350° F. to produce a heated, ruptured upper surface which is substantially free of moisture; and (d) pressing the heated, ruptured upper surface to provide a recycled pavement surface. An apparatus adapted for carrying out the process is also described.

14 Claims, 4 Drawing Sheets

PROCESS FOR RECYCLING AN ASPHALT SURFACE AND APPARATUS THEREFOR

TECHNICAL FIELD

The present invention relates to a process for recycling an asphalt surface and to apparatus therefor.

BACKGROUND ART

As used herein, the term asphalt also comprises macadam and tarmac. Asphalt paved road surfaces typically comprise a mixture of asphalt cement (typically a black, sticky, petrochemical binder) and an aggregate comprising appropriately sized stones and/or gravel. The asphalt concrete mixture is usually laid, compressed and smoothed to provide an asphalt paved road surface.

Over time, an asphalt paved road surface can deteriorate as a result of a number of factors. For example, seasonal temperature fluctuations can cause the road surface to become brittle and/or cracked. Erosion or compaction of the road bed beneath the road surface may also result in cracking. Moreover, certain of the chemical constituents incorporated in fresh asphalt are gradually lost over time or their properties changed with time, further contributing to brittleness and/or cracking of the road surface. Where concentrated cracking occurs, pieces of pavement may become dislodged. This dislodgement can create traffic hazards, and accelerates the deterioration of adjacent pavement and highway substructure. Even if cracking and the loss of pavement pieces do not occur, the passage of traffic can polish the upper highway surface, and such a surface can be slippery and dangerous. In addition, traffic-caused wear can groove, trough, rut and crack a highway surface. Under wet highway conditions, water can collect in these imperfections and set up dangerous vehicle hydro-planing phenomena. Collected water also contributes to the further deterioration of the pavement.

Prior to about the 1970's, available methods for repairing old asphalt-paved road surfaces included: spot treatments such as patching or sealing, paving with new materials over top of the original surface, and removal of some of the original surface and replacement with new materials. Each of these methods had inherent drawbacks and limitations.

Since about the early 1970's, with increasing raw material, oil and energy costs, there has been a growing interest in trying to recycle the original asphalt. The world's highways have come to be recognized as a very significant renewable resource.

Early recycling techniques involved removing some of the original surface and transporting it to a centralized, stationary recycling plant where it would be mixed with new asphalt and/or rejuvenating chemicals. The rejuvenated paving material would then be trucked back to the work site and laid. These techniques had obvious limitations in terms of delay, transportation costs and the like.

Subsequently, technology was developed to recycle the old asphalt at the worksite in the field. Some such processes involved heating and are frequently referred to as "hot-in-place recycling" (hereinafter referred to as HIPR).

This technology comprises many known processes and machines in the prior art for recycling asphalt paved surfaces where the asphalt has broken down. Generally, these processes and machines operate on the premise of (i) heating the paved surface (typically by using large banks of heaters) to facilitate softening or plasticization of an exposed layer of the asphalt; (ii) mechanically breaking up (typically using devices such as rotating, toothed grinders; screw auger/mills; and rake-like scarifiers) the heated surface; (iii) applying fresh asphalt or asphalt rejuvenant to the heated, broken asphalt; (iv) distributing the mixture from (iii) over the road surface; and (v) compacting or pressing the distributed mixture to provide a recycled asphalt paved surface. In some cases, the heated, broken material can be removed altogether from the road surface, treated off the road surface and then returned to the surface and pressed into finished position. Much of the prior an relates to variations of some kind on this premise.

Over time, HIPR has had to address certain problems, some of which still exist today. For example, asphalt concrete (especially the asphalt cement within it) is susceptible to damage from heat. Thus, the mad surface has to be heated to the point where it was sufficiently softened for practical rupturing, but not to the point of harming it. Furthermore, it was recognized that asphalt concrete is increasingly hard to heat as the depth of the layer being heated increases. Many patents have attempted to address these problems.

U.S. Pat. No. 3,361,042 (Cutler) discloses a process for wad surfacing. The process comprises the steps of: heating the road surface in a non-oxidizing environment; scarifying the heated surface deeply; piling the scarified material in windrows; heating the piled windrows in a non-oxidizing atmosphere; initially planing, levelling and kneading the heated mixture; adding minor mounts of conventional tack coat; finally planing, levelling and kneading the mixture; tamping and screeding the mixture; and compacting the mixture. The steps of initial and final planing, levelling and kneading of the mixture may be repeated during or omitted from the process.

U.S. Pat. No. 3,970,404 (Benedetti) discloses a method of reconstructing asphalt pavement. Generally, the method comprises heating the asphalt surface in successive stages during timed intervals. This gradual heating apparently permits the heat to penetrate the asphalt more deeply with minimal or no overheating thereof. The heated asphalt is then scarified to a depth not greater than that to which it has been heated. The scarified asphalt is then worked to provide a recycled asphalt surface. This method is somewhat inefficient since scarifying is effected only when the heat has penetrated the asphalt surface to a desired depth. As is well known in the art, in certain instances, the depth of heat penetration is directly related to the square root of the time provided for heat penetration, i.e.—25 seconds may be required for the heat to penetrate to a depth of 5 millimeters while 49 seconds may be required for the heat to penetrate to a depth of 7 millimeters. Thus, increasing the time allowance for desired heat penetration results in a decrease in overall process efficiency.

U.S. Pat. No. 3,843,274 (Gutman et al) discloses an asphalt reclaimer. Generally, the reclaimer is adapted to carry out the following steps: heating the asphalt surface, cutting the heated surface, conveying the cut surface away from the road to a pugmill, pulverizing the cut surface in the pugmill, redistributing the pulverized asphalt back onto the road surface and levelling the redistributed asphalt to provide a recycled asphalt surface.

U.S. Pat. No. 3,989,401 (Moench) discloses an apparatus for renewing or reconditioning asphaltic pavement surfaces. Generally, the apparatus comprises a hood and burner assembly which heats a surface over which it is moved, a scaring assembly that scrapes, breaks up and distributes the heated surface material and a levelling assembly that levels the scarified surface and material. This reference does not disclose or suggest processing of the scarified material to rejuvenate it in place.

U.S. Pat. No. 4,011,023 (Cutler) discloses a machine for recycling macadam highway pavement. The subject machine is intended to be used on a pavement surface which has been previously scarified or dislodged. This loose material is removed from the road surface, thereafter heated, mixed with fresh asphalt and spread on the original roadbed site. Heating is conducted off the road surface in a special chamber using a complicated multi-directional conveyor system. This machine is cumbersome and deficient since it requires complicated and expensive conveyors to remove the surface to be recycled from the road, to heat the removed material and reapply it thereafter.

U.S. Pat. No. 4,124,325 (Cutler) discloses a method and apparatus for recycling asphalt concrete roadways. Essentially, the process comprises heating the pavement surface with propane fired emitters; scarifying the heated surface to penetrate and excavate the entire surface to a depth of approximately ¾ inch; applying asphalt over the heated, scarified surface; mixing the excavated material; commingling the excavated material with additional hot mix in a pugmill rotor; and levelling the mix from the pugmill rotor on the roadway to provide a recycled asphalt surface.

U.S. Pat. Nos. 4,129,398 and 4,335,975 (both to Schoelkopf) disclose a method and apparatus for plastifying and tearing up of damaged mad surfaces and covers. The method comprises plastifying (heating) and breaking up the road surface with first and second separate and distinct devices. The second device aim serves the purpose of distributing, rearranging and profiling the broken-up material on the road surface in the absence of fresh asphalt being applied to the road surface. Thereafter, a third separate and distinct device is used to apply fresh asphalt or other bituminous material onto the broken-up, distributed, rearranged and profiled top surface of the road.

U.S. Pat. No. 4,226,552 (Moench) discloses an asphaltic pavement treatment apparatus and method. Generally, the method comprises heating and scarifying the asphalt surface to form a loose aggregate-asphaltic mixture on the ground surface. This mixture is then removed from the ground surface, heated, thoroughly mixed with a conditioner for the asphalt and reapplied to the ground surface as a mat. This method is inefficient since each treatment is carried out by an independently operable, portable apparatus and since the asphaltic must be removed from the road surface for reconditioning.

U.S. Pat. No. 4,534,674 (Cutler) discloses a dual lift repaving machine. The machine includes, in series: a preliminary heater; a preliminary scarifier; a main heater; a main scarifier; a sprayer for spraying liquid asphalt cutback onto the heated, scarified road surface; a first macadam dispensing device to dispense hot mix onto the sprayed, heated, scarified road surface; a first mixer for commingling the hot mix and the sprayed, heated, scarified road surface; a first screed to level and partly compact the material to form the first lift; a second macadam dispensing device to dispense additional hot mix onto the road surface; a second mixer for mixing the hot mix in situ; and a second screed to level and compact the new hot mix to provide a second road lift. The necessity of providing two lifts renders this machine complicated to use and relatively expensive to acquire.

U.S. Pat. No. 4,545,700 (Yates) discloses a process for recycling asphalt pavement. Essentially, the process purports to overcome the difficulties associated with inefficient heat penetration into the asphalt surface by providing steps of serially heating and milling multiple layers of the asphalt surface until the desired depth of asphalt has been removed and then, optionally, mixing the heated asphalt with additives. Typically, each heating/milling step results in removal of a strip which is at least ¼ inch deep. This process requires the use of many heaters and millers which are complicated and expensive machines.

U.S. Pat. No. 4,711,600 (Yates) discloses a heating device for use with asphalt pavement resurfacing equipment. The only example of resurfacing equipment disclosed is an apparatus in which layers of the road surface are successively heated, milled and removed from the road surface, via conveyors, for mixing with fresh asphalt or asphalt rejuvenant, and subsequent reapplication to the road surface. The use of a plurality of conveyors can be problematic since it adds excessive cost and complexity to the task at hand.

U.S. Pat. No. 4,784,518 (Cutler) discloses a double-stage repaving method and apparatus. The subject method includes a first stage comprising the steps of: heating an upper layer of an asphalt surface; scarifying the heated upper layer; adding recycling agent to the upper layer and thoroughly mixing and screeding the mixture to form recycled material; and adding fresh asphalt to the recycled material and milling the combination to form a mixed material thereby leaving exposed a lower layer of asphalt material. The second stage in the method comprises: conveying the mixed material from the first stage away to a paving station at the end of the process; subjecting the exposed lower layer of asphalt material to the same heating, scarifying, treatment and working steps to which the upper layer was subject; and laying the mixed material down on the exposed road surface (i.e. upper and lower asphalt layers removed) to provide a recycled road surface. This method is deficient as it requires the use of two relatively expensive and complicated conveyors.

U.S. Pat. No. 4,793,730 (Butch) discloses a method and apparatus for asphalt surface renewal. Generally, the method comprises the steps of: steam heating the asphalt surface; breaking the heated surface to a depth of about two inches and thoroughly mixing in situ lower material in the asphalt with the broken material; further steam heating the material to fuse the heated mixture into a homogeneous surface; screeding the homogeneous surface; and compacting the screed surface. The method and apparatus purportedly can be used to resurface asphaltic paving surfaces without requiting the addition of new materials or rejuvenants.

U.S. Pat. No. 4,929,120 (Wiley et al) discloses a two-stage process for rejuvenating asphalt-paved wad surfaces. In the first stage of the process, the entire width of the original asphalt surface is heated to a depth of about 1 inch and a temperature of about 300° F. The hated upper surface is then removed completely from the wad surface (using scarifying, windrowing and conveying techniques) to expose a lower asphalt surface corresponding to the entire width of the original asphalt surface. In the second stage of the process, the lower asphalt surface is heated to a depth of about 1 inch and a temperature of about 300° F. The heated lower surface is then ruptured (e.g. scarified) and either left in place or completely removed from the wad surface. If the ruptured lower surface is left in place, asphalt from the upper layer and, optionally, fresh asphalt (or asphalt rejuvenant is applied thereover. Alternatively, if the ruptured lower surface is completely removed it may be commingled with asphalt from the upper layer and, optionally, fresh asphalt (or asphalt rejuvenant), and thereafter returned to the wad surface. Finally, pressure is applied to force the upper/lower layer mixture against the road surface to provide a smooth, recycled surface. This process is somewhat deficient since it requires removal of at least the upper portion of the asphalt surface necessitating the use of relatively expensive and complicated equipment.

U.S. Pat. No. 4,850,740 (Wiley) discloses a method and apparatus for preparing asphaltic pavement for repaving. This patent purportedly provides an improvement over U.S. Pat. No. 4,929,120 by eliminating the need to remove the upper layer of heated, scarified asphalt completely away from the wad surface prior to treatment of the lower layer of asphalt. Essentially, the improvement relates to heating, scarifying and windrowing the asphalt surface in a manner to provide a central strip comprising windrowed material from outer strips of the asphalt surface piled onto an untreated (i.e. not scarified/removed) central strip of the asphalt surface. The central strip is then ground to mix the centrally windrowed material with the previously unground central strip of the asphalt surface. This mix is then spread over the entire asphalt surface and pressed into place. This proems is somewhat deficient since it requires two separate and distinct grinding steps.

It would be desirable to have a method and apparatus for recycling asphalt surfaces which method and apparatus overcome or reduce at least one of the above-identified disadvantages of the prior art.

DISCLOSURE OF THE INVENTION

It is an object of the present invention to provide a novel method for recycling an asphalt surface which obviates or mitigates at least one of the disadvantages of the prior art.

It is another object of the present invention to provide a novel apparatus for recycling an asphalt surface which obviates or mitigates at least one of the disadvantages of the prior art.

The present inventor has discovered that it is possible to achieve substantially uniform heating of the asphaltic surface to be recycled in an efficient manner while obviating the requirement to use multiple cycles of heating and rupturing of layers of the paved (typically asphalt) surface. More specifically, it has been discovered that more uniform heating of the asphalt surface may be achieved in a relatively efficient manner if all or at least some of the heating of the asphalt surface is conducted after rupturing (rather than before as described in many prior art processes and apparatus). One of the major impediments to uniform, thorough and efficient penetration of heat into an asphalt surface is water or moisture. Specifically, the presence of water or moisture on or beneath the asphalt surface makes it virtually impossible to heat the surface in a uniform and efficient manner. Thus, it is not surprising that many prior an processes which emphasized vigorous initial heating to soften the surface to be recycled are not commercially viable since the compacted asphalt surface is relatively impermeable to moisture release.

The present inventor has discovered that applying substantially all or at least the bulk of the heat in combination with mixing techniques after grinding allows for efficient and thorough moisture release from the asphalt which results in improved uniform and efficient heating thereof. Further, the release of moisture from the asphalt results in minimizing the likelihood of "stripping" in the recycled surface. As is known in the art, "stripping" is an undesirable and common phenomenon relating to the presence of a moisture interface between the aggregate and the asphalt cement. The provision of concentrated heating and mixing efforts at a point after rupturing results in many advantages. First, only a single rupturing step is required. This simplifies the overall process and provides significant savings in equipment costs. Second, by heating and mixing the ruptured asphalt on the unruptured asphalt surface therebeneath, the use of conveyors, elevators and other lifting devices is obviated; again this makes the overall process more cost efficient. Third, since the ruptured asphalt is heated uniformly and moisture is substantially eliminated therefrom, if additives are to be used, they may be applied directly to the ruptured asphalt thereby, in certain instances, avoiding the use of mixers such as pugmills for homogenous mixing of the additives (although it should be clear that such mixers can be used in conjunction with the present process and apparatus).

Moreover, heating and mixing the grounds in this fashion facilitates the addition of other components to the grounds. Indeed, it is a preferred aspect of the present invention to add components such as fresh asphalt, asphalt rejuvenant and aggregate (e.g. sand, gravel, stone and the like) to the asphalt surface prior or subsequent rupturing thereof at the appropriate point in the process, which point can readily be determined by a person skilled in the art.

Accordingly, in one of its aspects, the present invention provides a process for recycling an asphaltic surface comprising the steps of:

(a) rupturing the upper surface of an asphaltic surface to be recycled to a depth of at least about 1.5 inches to provide a ruptured upper surface;

(b) heating and mixing the ruptured upper surface on the asphalt surface to a temperature in the range of from about 100° to about 350° F. to produce a heated, ruptured upper surface which is substantially free of moisture;

(c) pressing the heated, ruptured upper surface to provide a recycled asphaltic surface.

In another of its aspects, the present invention provides an asphaltic surface recycling apparatus comprising:

(a) rupturing means for rupturing an upper surface of said asphalt surface to produce a ruptured upper surface;

(b) heating means and mixing means for heating said ruptured upper surface to a temperature in the range of from about 100° to about 350° F. to produce a heated, ruptured upper surface which is substantially free of moisture; and (c) means for pressing said heated, ruptured upper surface to provide a recycled asphaltic surface.

In another of its aspects, the present invention provides an asphaltic surface pre-conditioning machine for use in heating and mixing a substrate selected from (i) aggregate on the asphalt surface or (ii) ruptured asphaltic surface prior to re-laying thereof, the machine comprising a bank of heaters having a plurality of elongate heaters in a side-by-side arrangement, a mixing element being disposed between adjacent elongate heaters the mixing element comprising a blade member capable of being at least partially immersed in the substrate.

Although the use of a heater prior to grinding (i.e. a pre-heater) is not required for proper operation of the present process and apparatus, in certain instances it is preferred, to facilitate the rupturing step. It should be appreciated that when such a pre-heater is utilized, it is for the purpose of facilitating the rupturing step and is not primarily responsible for achieving uniform heat distribution throughout the asphalt surface.

One of the advantages of the present process and apparatus is that only a single rupturing step is required. The term "rupturing" is well known to those in the asphalt surface recycling art and as used throughout the present specification is intended to include techniques such as grinding, milling and scarifying. Typically, rupturing is also the factor which dictates the depth to which recycling is conducted. Accordingly, it should be appreciated that the desired depth of asphalt recycling using the present process and apparatus is achieved substantially exclusively by rupturing. In other words, other steps in the process (e.g. levelling, mixing and the like) may result in negligible breaches in the asphalt surface, however these have a correspondingly small effect on the depth of recycling and should not be considered as rupturing.

The heater useful in the present process and apparatus is not particularly restricted. Preferably, the heater is a radiant heater, more preferably an infrared heater. Alternatively, hot air heaters may be used.

The manner by which the upper surface for recycling is ruptured is not particularly restricted. Thus, use may be made of conventional techniques such as grinding, milling, ratifying and the like. It is preferred to use a grinder in the present process and apparatus. This grinder may be a full width grinder, that is one extending across the entire width of the upper surface to be recycled. Alternatively, the grinder may comprise two or more grinders appropriately arranged to have the cumulative effect of grinding substantially the entire width of the upper surface to be recycled.

The upper surface is ruptured to a depth of at least about 1.5 inches to provide a ruptured upper surface. Preferably, the surface is ruptured to a depth in the range of from about 2 to about 3 inches. It should be understood that, in the present process and apparatus, rupturing at this point should be done to a desired depth. This simplifies the present process and apparatus and indeed represents one of the advantages over the prior art.

The ruptured upper surface is heated and mixed while it remains on the asphalt surface to a temperature in the range of from about 100° to about 350° F. to produce a heated, ruptured upper surface which is substantially free of moisture. Preferably, the raptured upper surface is heated and mixed to a temperature in the range of from about 100° to about 180° F.—this is known as warm-in-place (i.e. relative to HIPR) recycling. Alternatively, when it is desired to conduct HIPR, it is preferred to heat and mix the raptured upper surface to a temperature in the range of from about 180° to about 250° F.

The term "mixing" and "mixed" as used herein encompasses a form of mixing more akin to stirring. Specifically, the action of mixing or stirring using the present process or apparatus results in a "new" surface of the ruptured upper surface being exposed to heat. This facilitates water or moisture release from the ruptured upper surface.

It is preferred to conduct heating and mixing of the raptured upper surface using at least one bank of heaters which comprises a plurality of individual heaters, each heater extending across the width of the upper surface and being in a side-by-side relationship with respect to adjacent heaters. Between each heater, it is preferred to dispose a mixing means comprising a plurality of blade members which extend in a downward direction substantially normal to the asphalt surface. It is preferred that the mixing means not abut nor grind asphalt beneath the ruptured upper surface. This prevents damage to either or both of the mixing element and the unruptured asphalt surface.

This arrangement of heaters and mixing elements provides for successive cycles of heating and mixing of the ruptured upper surface. After mixing, the ruptured upper surface has been rearranged to expose different portions of the ruptured surface to the next bank of heaters. It is preferred that each bank of heaters comprises sufficient individual heaters and mixing elements to provide at least two, more preferably from two to six, cycles of heating and mixing.

In a more preferred embodiment of the present process and apparatus, a supplementary mixer is provided after the bank of heaters (i.e., comprising a plurality of individual heaters having disposed therebetween the mixing elements) which effectively redistributes the ruptured upper surface in a substantially level, uniform layer for further processing. It is preferred that the supplementary mixer comprise an auger which extends substantially along the full width of the upper surface and a ramp immediately after the auger. In use, the auger abuts (but does not rupture or penetrate) the unruptured asphalt layer beneath the ruptured upper surface and serves to scoop up the ruptured upper surface and distribute it to the ramp for redistribution on the unruptured asphalt surface. The effect of the supplementary mixer is to assist in bottom to top mixing of any portion of the ruptured upper surface which may have passed below the mixing elements in the bank of heaters.

In a most preferred embodiment of the present process and apparatus, use is made of two banks of heaters comprising individual heaters having mixing elements disposed therebetween, together with the supplementary mixer following each bank of heaters. It is preferred to use a levelling bar at the tail end of each bank of heaters since the mixing elements may produce a furrowed or windrowed effect in the ruptured upper surface. The levelling bar may be used to eliminate the windrow or furrow effect to produce a substantially uniform and level layer of ruptured upper surface on the unruptured asphalt surface therebeneath. After the ruptured upper surface has been heated to the desired temperature and is substantially free from moisture, it may be pressed back into place to provide a recycled pavement surface. The means of accomplishing this is not particularly restricted and is well known to those skilled in the art. In certain cases, it may be desirable to feed the heated, ruptured upper surface to a pugmill mixer (or other equivalent mixing device) for mixing additives with the ruptured upper surface. After mixing in the pugmill mixer, the hot mix may be applied to the unruptured asphalt surface and pressed into placed using conventional techniques.

If a pugmill mixer is utilized resulting in removal of the heated, ruptured upper surface from the unruptured asphalt surface, it is preferred to heat the latter to improve the tackiness thereof thereby facilitating good adhesion between it and the reapplied hot mix. Such heating can be accomplished using a conventional infrared heater.

BRIEF DESCRIPTION OF THE DRAWINGS

Embodiments of the present invention will be described hereinafter with reference to the accompanying drawings, wherein like numerals are intended to designated like parts, in which.

BEST MODE FOR CARRYING OUT THE INVENTION

Figure 1:
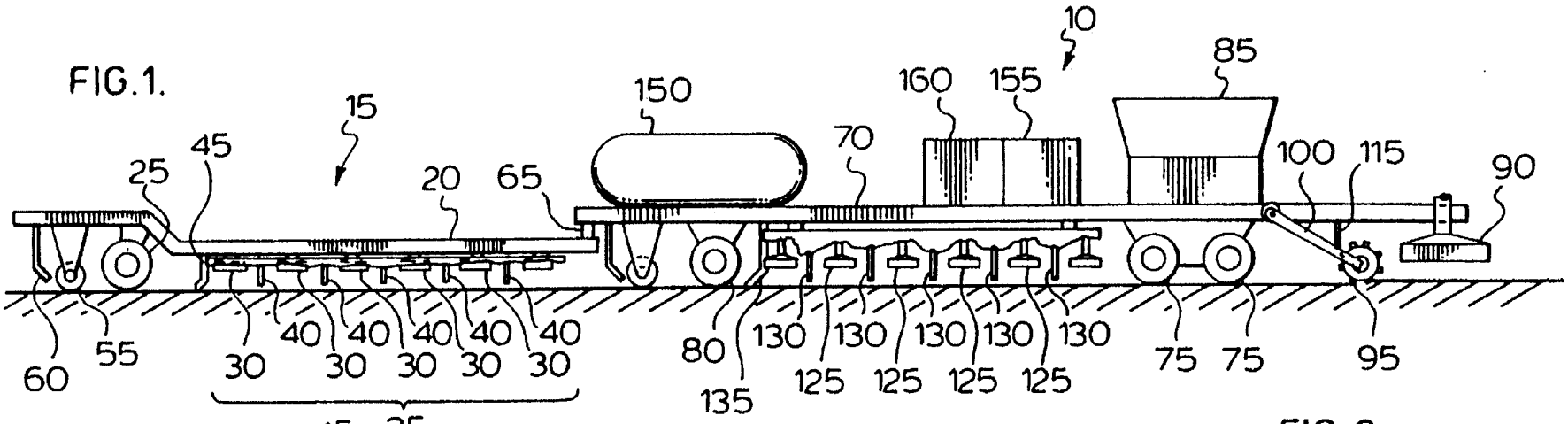
FIG. 1 is a side view of a portion of an apparatus in accordance with the present invention indicating the layout of the banks of heating elements, the mixers and the grinder in relationship to the vehicles used to support them.
Figure 2:
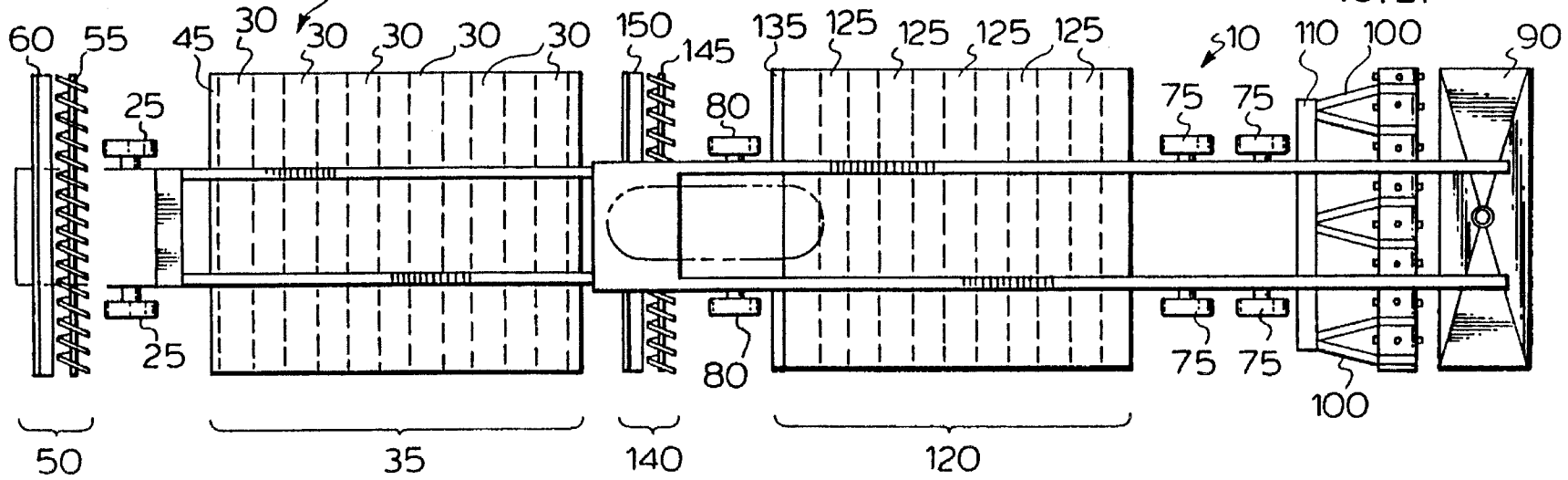
FIG. 2 is a top plan view of the apparatus shown in FIG. 1.

With reference to FIGS. 1 and 2 an asphalt recycling apparatus is shown which comprises a self-propelled vehicle, indicated generally at 10, to which is attached a trailer section 15. Trailer section 15 comprises a platform 20 supported by a pair of wheels 25 at one end thereof.

Trailer section 15 comprises propane fired elongated infra red heaters 30 which are arranged in rows extending across a strip of ruptured asphalt surface to be heated. Six of heaters 30 make a bank of heaters 35 with each heater 30 being separated by a mixing element 40. Each mixing element 40 extends across the strip of ruptured asphalt surface to be heated and comprises a plurality of mixing blades which are disposed substantially normal to the asphalt surface to provide mixing of ruptured asphalt. The mixing blades are kept approximately one half inch above the unruptured asphalt surface to prevent damage to the mixing blades and to the unruptured asphalt. At the rear of bank of heaters 35 is a levelling bar 45 which serves to provide a level surface of ruptured material. In use, levelling bar 45 abuts against the ruptured asphalt surface.

At the rear of trailer section 15, there is provided a supplementary mixer 50 comprising an auger 55 and a mixing ramp 60. Auger 55 extends across the ruptured asphalt surface and is designed to assist in mixing of ruptured asphalt which may not be adequately mixed by mixing elements 40 since there is an approximately one half inch layer of ruptured asphalt which is not continuously mixed. Thus, auger 55 abuts the unruptured asphalt surface and serves to achieve bottom to top mixing of the asphalt ruptures which are then fed to ramp 60. Ramp 60 is disposed such that it also abuts the unruptured asphalt surface. Ramp 60 provides an even distribution of the ruptured asphalt on substantially the entire width of the road surface to be recycled.

Trailer section 15 is coupled to the rear of vehicle 10 by any suitable linkage 65. The steering of wheels 25 of trailer section 15 may be remotely controlled through a microprocessor unit (not shown) located on vehicle 10.

Vehicle 10 comprises a platform 70 support by front wheels 75 and rear wheels 80, both of which may be turned in response to remote control signals applied by an operator in operator's booth 85 at the front of vehicle 10. The front end of vehicle 10 comprises a grinding unit. This grinding unit comprises a grinder 95 which extends across the full width of the asphalt surface to be recycled. Alternatively, the grinding unit may comprise a plurality of grinders (not shown) which provide the cumulative effect of full width grinder 95—see, for example, the grinders disclosed in U.S. Pat. No. 4,850,740. Grinder 95 is supported by V-brace members 100 connected to support beam 110 which is affixed to platform 70 of vehicle 10. At the rear of grinder 95 there is disposed a substantially vertically oriented blade 115 which extends down to the level of the cutting edges of grinder 95.

The rear portion of vehicle 10 comprises a bank of heaters 120 comprised of six rows of propane fired elongated infrared heaters 125 of a type similar to heaters 30 of trailer section 15 described hereinabove. Between each of heaters 125 there is disposed a mixing element 130 which is substantially the same as mixing element 40 disposed between heaters 30 of trailer section 15 described above. At the rear of bank of heaters 120 there is disposed a levelling bar 135 which is of similar design and purpose as levelling bar 45 of trailer section 15 described hereinabove. At the rear end of vehicle 10, there is provided a supplementary mixer 140 comprising an auger 145 and a mixing ramp 150. Supplementary mixer 140 is of similar design and purpose as supplementary mixer 50 of trailer section 15 described hereinabove. It will be appreciated that supplementary mixer 140 may be mounted to the rear of vehicle 10 or the front of trailer section 15.

Platform 70 of vehicle 10 may be used to support a variety of different devices typically utilized in the operation of asphalt recycling equipment. For example, platform 70 may support a propane tank 150 for feeding fuel to banks of heaters 35 and 120. Further, platform 70 may support an asphalt additive tank 155 and an aggregate additive tank 160.

Asphalt additive tank 155 may be use to supply fresh asphalt or asphalt rejuvenant to the asphalt at an appropriate point during the process. For example, fresh asphalt or asphalt rejuvenant may be added to the asphalt surface (i) prior to bank of heaters 120; (ii) between bank of heaters 120 and bank of heaters 35; (iii) after bank of heaters 35; or (iv) concurrently with use of either or both of bank of heaters 120 and bank of heaters 35. Of course, it is also possible to added fresh asphalt or asphalt rejuvenant using a combination of two or more of (i), (ii), (iii) and (iv).

A particularly preferred aspect of the present process and apparatus relates to the addition of aggregate to the asphalt surface. This may be done at any convenient point or points throughout the process. For example, the aggregate from aggregate additive tank (or hopper) 160 may be added to the asphalt surface: (i) prior to grinder 95; (ii) prior to bank of heaters 120; (iii) between bank of heaters 120 and bank of heaters 35; (iv) after bank of heaters 35; or (v) concurrently with use of either or both of bank of heaters 120 and bank of heaters 35. Of course, it is also possible to added fresh asphalt or asphalt rejuvenant using a combination of two or more of (i), (ii), (iii) and (iv). If option (i) is used, lubrication of rupturing is enhanced. Preferably, the aggregate is added at ambient temperature at a point after grinder 95 and prior to bank of heaters 120. This is a particularly advantageous feature of the invention since the aggregate becomes heated in the subsequent heating/mixing steps thereby obviating the need for obtaining the aggregate in a pre-heated state.

While it is not necessary to heat the asphalt surface prior to rupturing thereof, it is preferred to employ the use of a pre-heater 90 prior to grinder 95. The choice of pre-heater is not particularly restricted and such devices may be obtained from a variety of commercial sources.

Figure 3:
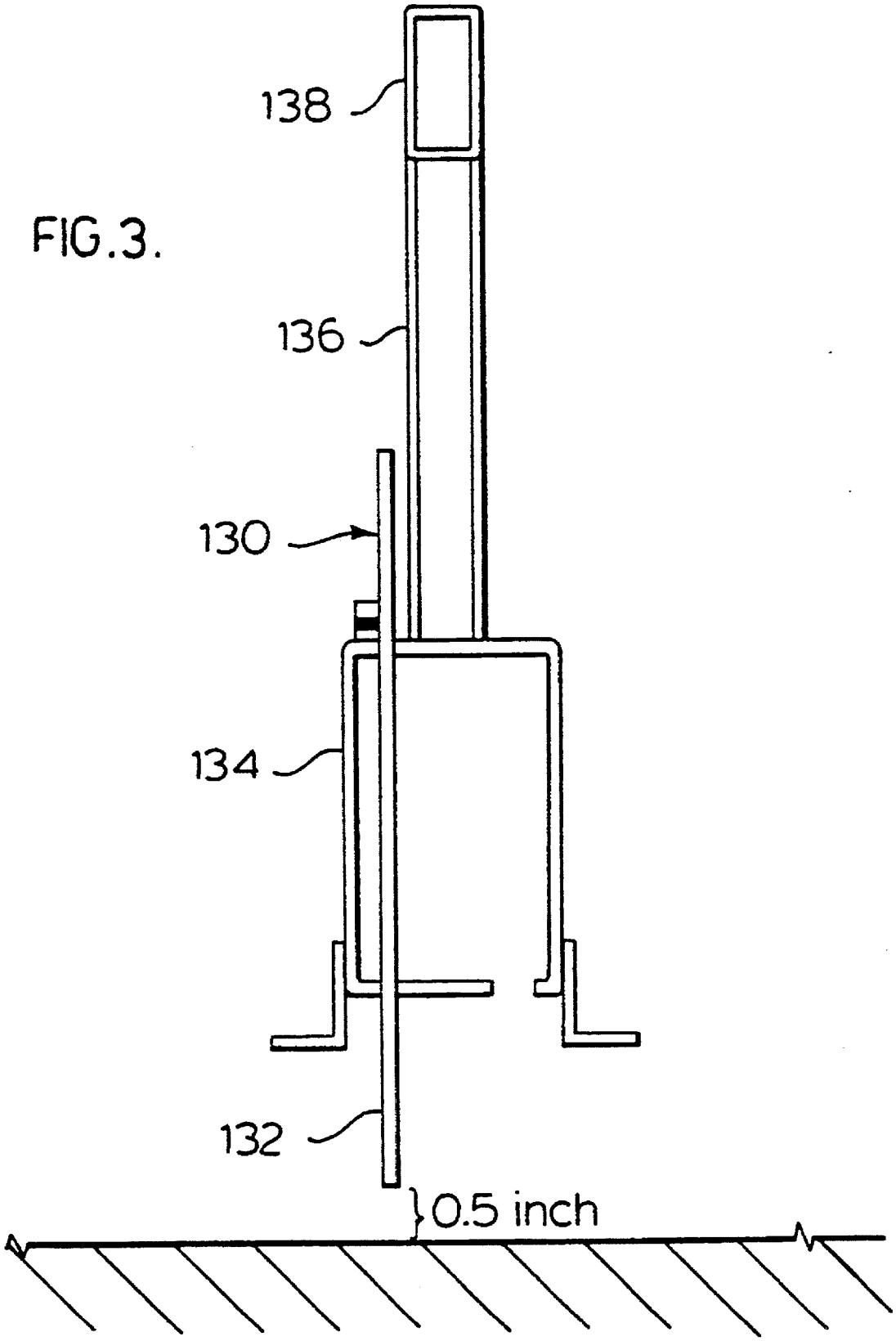
FIG. 3 is a sectional view of a mixing element useful in the apparatus shown in FIGS. 1 and 2.
Figure 4:
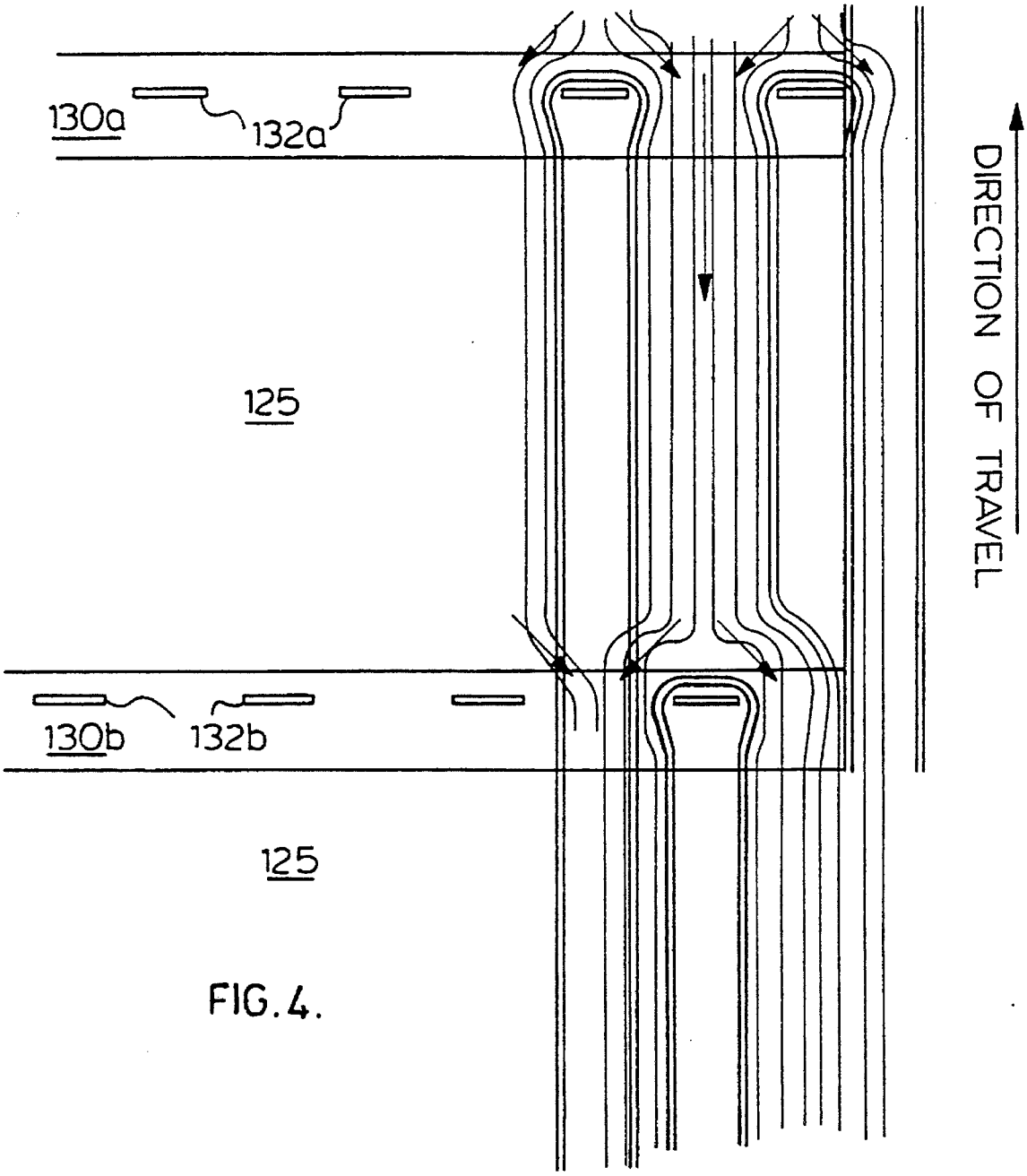
FIG. 4 is a top view, in partial section, of the use of the mixing element shown in FIG. 3.

The mixing contemplated herein is readily understood with reference to FIGS. 3 and 4. In FIG. 3 an enlarged section of mixing element 130 is illustrated. As shown, mixing element 130 comprises a blade 132 disposed about one half inch above the unruptured asphalt. It will be understood that, in use, the tip of blade 132 will be immersed in the ruptured upper layer which has been ruptured to a depth of at least about 1.5 inches. Blade 132 is maintained above the unruptured asphalt surface to avoid damage to the blade itself or to the unruptured surface. The distance above the unruptured surface has been disclosed and illustrated as being one half inch. It should be clearly understood that the exact distance is not critical provided that it not be so small as to result in blade damage or too large as to result in inefficient mixing. For example, it is contemplated to utilize a resiliently biased (e.g. spring) blade which contacts the unruptured surface in use and relies on its resilient mount to avoid damage thereto.

Blade 132 is mounted in a suitable housing 134 which allows for vertical adjustment thereof. Housing 134 is affixed to a pillar 136 which in turn is connected to a support beam 138 which corresponds to the width of bank of heaters 120. Beam 138 may be connected directly or indirectly to platform 70 using any convenient connections means (not shown). It should be clearly understood that mixing element 40 on Wailer section 15 may be and is preferred to be of the same design as mixing element 130 illustrated in FIG. 3.

With reference to FIG. 4, successive mixing elements 130*a* and 130*b* are arranged in a staggered manner such that their respective blades 132*a* and 132*b* are offset with respect to one another. This arrangement effectively provides channels through which the ruptured upper surface can pass as illustrated on the right side of FIG. 4. This creates a furrowed or windrowed pattern of the ruptured upper surface over the unruptured asphalt surface, wherein each pass of a mixing element 130 stirs the ruptured surface.

Figure 5:
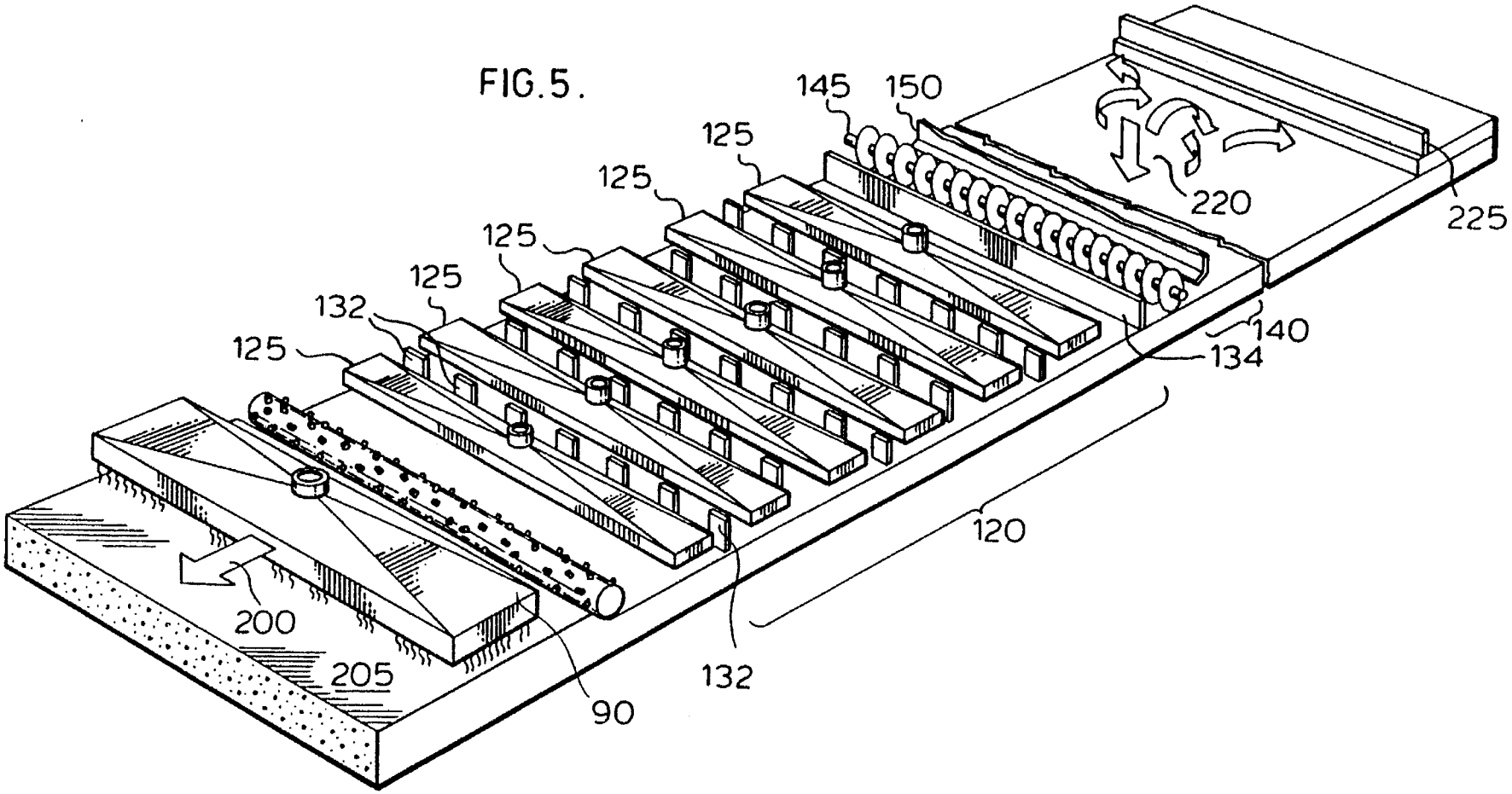
FIG. 5 is a schematic perspective diagram showing the material process and flow accomplished by, inter alia, the apparatus shown in FIGS. 1 and 2.

With reference to FIG. 5, the operation of the present process and apparatus will be described. The direction of travel of the apparatus is depicted generally by arrow 200. Initially, there is provided an asphalt surface having an upper surface 205 in need of recycling. Upper surface 205 is subjected to pre-heating by heater 90 which heats upper surface 205 to a temperature of from about 100° to about 350° F. Thereafter, heated upper surface 205 is then ruptured, in this case by grinder 95, to a depth of at least about 1.5 inches and preferably to a depth of from about 2.0 to about 3.0 inches to provide a ruptured upper surface. The ruptured upper surface is then passed over by bank of heaters 120 comprising mixing elements 130 disposed between each elongated heater 125. At this point, it should be clearly understood that, for sake of clarity and ease of illustration, the ruptured upper surface has not been illustrated in FIG. 5.

Each heater 125 in bank 120 heats the ruptured surface which is then mixed by blades 132 of mixing elements 130 prior to subsequent heating and/or processing. Heater bank 120 effectively provides for continuous heating and mixing (or stirring) of the ruptured upper surface while it is on the unruptured asphalt therebeneath.

Levelling bar 135 at the end of bank of heaters 120 serves to substantially eliminate the furrowed or windrowed pattern of the ruptured upper surface to provide a relatively level and even distribution of ruptured upper surface over the unruptured asphalt surface therebeneath. As disclosed hereinabove, levelling bar 135 abuts the unruptured asphalt surface to assist mixing of ruptured upper surface which may have eluded mixing elements 130. The use of levelling bars is well known in the art and requires no further detailed elaboration herein.

After the levelling bar 135, the heated, ruptured upper surface is passed over by supplementary mixer 140. Auger 145 of supplementary mixer 140 abuts the surface of the unruptured asphalt surface and serves to effect bottom to top mixing of the ruptured upper surface. By this, it is meant that a portion of the ruptured upper surface which traversed beneath mixing elements 130 is scooped up and mixed and distributed on to ramp 150 which serves to redistribute the mix in a substantially uniform level manner on to the asphalt surface.

For clarity and ease of illustration, bank of heaters 35, mixing elements 40, levelling bar 45 and supplementary mixer 50 of trailer section 15 have not been depicted in FIG. 5. It will be clearly understood that these units function in the same manner as their respective counterparts on vehicle 10, which counterparts are depicted in FIG. 5.

After the final bank of heaters, fresh asphalt or asphalt rejuvenants may be added as desired and the mixture of fresh asphalt or asphalt rejuvenant and the heated, ruptured upper surface may be mixed, as indicated schematically by arrows 220, in a pugmill mixer (not shown). The mixed material may be further processed by levelling it out with a screed 225.

As will be appreciated, many variations of the disclosed process and apparatus are possible without deviating from the spirit and substance thereof. For example, a number of rupturing techniques may be used prior to intensive heating and mixing. While grinding has been disclosed to obtain the ruptured surface, it should be clear to most skilled in the art that scarifying, taking, milling and the like are also suitable.

Accordingly, while this invention has been described with reference to illustrative embodiments, this description is not intended to be construed in a limiting sense. Various modifications of the illustrative embodiments as well as other embodiments of the invention, will be apparent to persons skilled in the an upon reference to this description. It is therefore contemplated that the appended claims will cover any such modifications or embodiments.

What is claimed is:

1. An asphaltic surface recycling apparatus comprising:

(a) rupturing means for rupturing an upper surface of said asphalt surface to produce a ruptured upper surface;

(b) heating means and mixing means for heating said ruptured upper surface to a temperature in the range of from about 100° to about 300° F. to produce a heated, ruptured upper surface which is substantially free of moisture, said heating means comprising a bank of heaters extending across the width of the upper surface and said mixing means comprising a mixing element being disposed between said heaters; and (c) means for pressing said heated, ruptured upper surface to provide a recycled pavement surface.

2. The apparatus defined in claim 1, wherein said heating means and mixing means comprises a bank of heaters comprising a plurality of individual elongate heaters in a side-by-side arrangement extending across the width of the upper surface, a mixing element being provided between each heater.

3. The apparatus defined in claim 2, wherein said elongate heaters are in a spaced side-by-side arrangement.

4. The apparatus defined in claim 1, further including a pre-heater to heat said asphalt surface prior to rupturing.

5. The apparatus defined in claim 1, further including means for supplying a rejuvenant to said ruptured upper surface.

6. The apparatus defined in claim 1, further including:

a supplementary mixer;

means for supplying at least a portion of said ruptured upper surface to said supplementary mixer; and means for re-laying the mixed portion of said ruptured upper surface onto said asphalt surface.

7. The apparatus defined in claim 1, further comprising means to supply a rejuvenant to said supplemental mixer for mixing with said portion of said ruptured upper surface.

8. The apparatus defined in claim 1 wherein said rupturing means is a grinder.

9. The apparatus defined in claim 8, wherein said grinder extends across the width of said upper surface.

10. The apparatus defined in claim 9, wherein the grinder includes a rotating portion with a plurality of protuberances spaced over the surface thereof and a vertical blade immediately behind said rotating portion and supported by a common frame within said rotating portion, said vertical blade normally contacting the pavement.

11. An asphaltic surface pre-conditioning machine for use in heating and mixing a substrate selected from (i) aggregate on the asphalt surface or (ii) ruptured asphaltic surface prior to re-laying thereof, the machine comprising at least one bank of heaters having a plurality of elongate heaters in a side-by-side arrangement, a mixing element being disposed between adjacent elongate heaters, the mixing element comprising a blade member capable of being at least partially immersed in the substrate.

12. The apparatus defined in claim 11, wherein the said mixing element comprises a series of spaced, depending mixing blades, the blades of each mixing element being staggered with respect to the blades of other mixing elements adjacent the mixing element.

13. The machine defined in claim 11, wherein said elongate heaters are in a spaced side-by-side arrangement.

14. The machine defined in claim 11, wherein the said mixing element comprises a series of spaced, depending mixing blades, the blades of each mixing element being staggered with respect to the blades of other mixing elements adjacent the mixing element.

* * * * *